United States Patent [19]

Richard et al.

[11] Patent Number: 5,014,449

[45] Date of Patent: May 14, 1991

[54] SHOE SOLE CONSTRUCTION

[75] Inventors: Daniel Richard, West Linn; Kenneth Kolman, Beaverton; Charles Case, Beaverton; Ronald Becker, Stayton, all of Oreg.; Alex Gross, Aspen, Colo.

[73] Assignee: Avia Group International, Inc., Portland, Oreg.

[21] Appl. No.: 411,044

[22] Filed: Sep. 22, 1989

[51] Int. Cl.[5] ..... A43B 13/18; A43B 21/26

[52] U.S. Cl. ..... 36/114; 36/28; 36/30 R; 36/29

[58] Field of Search ..... 36/114, 29, 28, 27, 36/35 R, 35 B, 7.8, 25, 30 R; 5/449, 450

[56] References Cited

U.S. PATENT DOCUMENTS

| | | | |
|---|---|---|---|
| 886,801 | 5/1908 | Harmon | 36/32 |
| 1,241,142 | 9/1917 | O'Hara | 36/28 |
| 3,087,262 | 4/1963 | Russell | 36/28 |
| 3,608,215 | 9/1971 | Fukuoka | 36/29 |
| 4,083,125 | 4/1978 | Benseler et al. | 36/32 R |
| 4,229,889 | 10/1980 | Petrosky | 36/29 |
| 4,342,158 | 8/1982 | McMahon et al. | 36/35 B |
| 4,561,140 | 12/1985 | Graham et al. | 36/37 |
| 4,670,995 | 6/1987 | Huang | 36/29 |
| 4,680,876 | 7/1987 | Peng | 36/37 |
| 4,741,114 | 5/1988 | Stubblefield | 36/114 |
| 4,753,022 | 6/1988 | Gasbarro | 36/29 |
| 4,768,295 | 9/1988 | Ito | 36/29 |
| 4,887,367 | 12/1989 | Mackness et al. | 36/35 B |
| 4,918,838 | 4/1990 | Chang | 36/29 |
| 4,918,841 | 4/1990 | Turner et al. | 36/28 |

FOREIGN PATENT DOCUMENTS

| | | | |
|---|---|---|---|
| 203631 | 5/1907 | Fed. Rep. of Germany . | |
| 2800359 | 7/1979 | Fed. Rep. of Germany | 36/28 |
| 417548 | 11/1910 | France | 36/7.8 |
| 777630 | 6/1957 | United Kingdom | 36/29 |
| 1603646 | 11/1981 | United Kingdom | 36/29 |

OTHER PUBLICATIONS

Lydico Shoe Brochure, Atlanta Super Show, Feb. 1990.

Footwear News Article, Dec. 11, 1989.

*Primary Examiner*—Steven N. Meyers

*Attorney, Agent, or Firm*—Sterne, Kessler, Goldstein & Fox

[57] ABSTRACT

The present invention comprises an intermediate layer for a shoe sole consisting of a hollow shell having convolutions disposed along the periphery thereof. The convolutions are adapted to cushion the foot by compressing when force is applied thereto, and expanding to their original configuration when the force is relieved. An inner filler material may be provided within the shell for added cushioning and resilience.

10 Claims, 7 Drawing Sheets

SHOE SOLE CONSTRUCTION

FIELD OF THE INVENTION

This invention relates to shoes, and more particularly to a shoe sole construction.

BACKGROUND OF THE INVENTION

Through the years, attempts have been made to produce footwear that is both comfortable and exhibits improved performance. Many attempts have proved unsatisfactory, in that they have failed to produce the desired effectiveness. A major emphasis of these attempts has been to increase the cushioning and performance of an athletic shoe by making modifications to the midsole (the material which generally lies above the outsole and below the insole). The numerous attempts to provide superior cushioning in athletic shoes have led to at least two broad categories of developments.

One category utilizes different materials and configurations of the midsole to improve cushioning, as well as to provide selective stability. For example, materials of different hardness may be used, or a variety of devices may be encapsulated in the midsole to increase cushioning and stability. Typically, such midsoles are constructed of cellular ethyl vinyl acetate (EVA), polyurethane (PU), or a combination of both. While EVA has the advantage of being light-weight, and PU has the advantage of increased memory capabilities and resilience, the cellular structure of both materials has a tendency to break down and therefore, diminish the useful lifespan of the midsole, and thus, the shoe.

A second category of developments in midsoles includes those structures which have encapsulated an insert within the midsole material itself. The insert, usually made of plastic material that is harder than the midsole material, does to a limited degree increase the lifespan of the shoe sole since, unlike the cellular material, it does not break down. However, as with the first category of developments, in the second category, the insert is still designed to be encapsulated within either EVA or PU. Therefore, this structure does not completely eliminate the tendency of the cellular material to break down. Thus, the lifespan of these midsoles is still seriously limited by the lifespan of the primary midsole material itself.

SUMMARY OF THE INVENTION

It is with these problems of the prior art in mind, that the present invention was developed. The present invention may be characterized as a shoe sole construction comprising an outer sole layer and an intermediate layer disposed above the outer sole layer. The intermediate layer may be comprised of a hollow outer shell defining an interior chamber. The shell may be comprised of a thermoplastic elastomer. An inner filler material may be encapsulated within the interior chamber of the intermediate layer. The filler material may be comprised of a synthetic foam. The foam is preferably selected from the group consisting of polyether polyurethane, polyester polyurethane and ethyl vinyl acetate. The shell may be formed by blow molding.

The present invention may also be characterized as a shoe sole construction comprising an intermediate layer for supporting the forces generated by a wearer. The intermediate layer may include a hollow outer shell having a plurality of convolutions arranged horizontally along a substantial portion of the outer periphery of the intermediate layer extending from the top surface to the bottom surface. The convolutions may be arranged in independent vertical columns along the outer periphery. A recess may be formed between adjacent columns. The columns may be uniformly arranged, and may be arranged at an angle to a central axis of the intermediate layer.

Furthermore, the present invention may be characterized as a midsole construction for a shoe comprising a resilient midsole cradle element having a cavity therein. A hollow insert may be disposed within the cavity. The hollow insert may include a plurality of convolutions arranged horizontally along a portion of the insert such that the convolutions compress in an accordion-like fashion when force from the foot of the wearer is applied thereto. The insert may be disposed in the heel region of the midsole; the forefoot region of the midsole; or both the heel and forefoot regions. The cavity may be formed in the upper surface, the bottom surface, or both the upper and bottom surfaces of the midsole cradle element.

In addition, the present invention may be characterized as a shoe sole construction comprising an outer sole having a plurality of lugs extending downwardly from a peripheral portion of the outer sole to create a concavity in the central portion of the outer sole. An intermediate layer may be disposed above the outer sole. The intermediate layer may include a plurality of convolutions formed along the periphery of the intermediate layer such that the convolutions are adapted to compress in an accordion-like fashion when the force from the foot of a wearer is applied thereto.

BRIEF DESCRIPTION OF THE DRAWINGS

Various objects, features, and attendant advantages of the present invention will be more fully appreciated as the same becomes better understood from the following detailed description of the present invention when considered in connection with the accompanying drawings in which.

DETAILED DESCRIPTION OF THE PREFERRED EMBODIMENT

Figure 1:
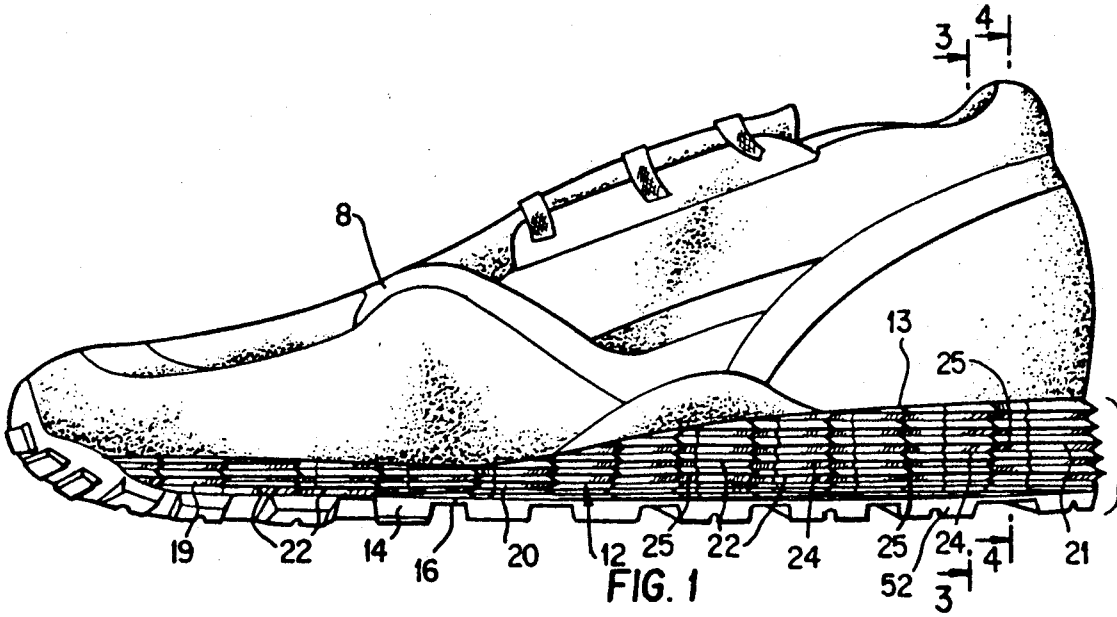
FIG. 1 is a right side view of an athletic shoe having the intermediate layer of the present invention.
Figure 2:
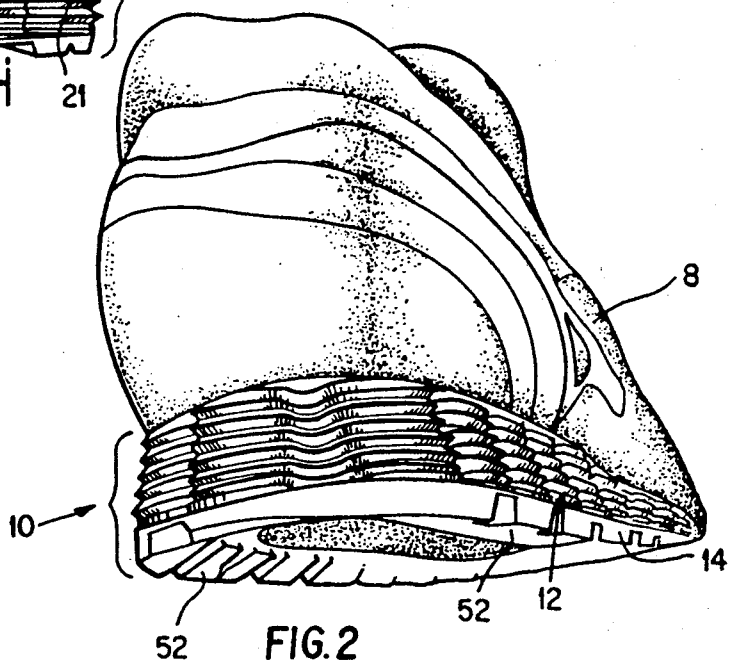
FIG. 2 is a rear perspective view of the athletic shoe shown in FIG. 1.

Referring now to the drawings, wherein like reference numerals represent identical or corresponding parts throughout the several views, FIG. 1 illustrates a right (medial) side view of an athletic shoe for the right foot of a wearer incorporating the intermediate layer of the present invention. An athletic shoe for the left foot having the intermediate layer of the present invention would be a mirror image of the one shown in FIG. 1. The upper of the athletic shoe, which does not form part of the present invention, is designated by reference numeral 8. Upper 8 may take numerous forms other than that shown in the figures. Similarly, while the present invention is shown embodied on an athletic shoe, the invention may be practiced on any type of footwear, including walking or dress shoes, and accordingly should not be limited to athletic shoes.

A shoe sole, disposed below upper 8, preferably includes an outer sole 14 and the intermediate layer or midsole of the present invention, designated generally by 12. Alternatively, outer sole 14 could be integral with intermediate layer 12. The periphery of outer sole 14 generally follows the profile of the human foot. Along the periphery of outer sole 14 are a plurality of lugs 52 which extend downwardly from outer sole 14. Lugs 52 create a concavity in the central portion of the heel region of outer sole 14 which advantageously provides improved shock absorption. The manner in which this is achieved is disclosed in U.S. Pat. No. 4,372,058 and is incorporated herein by reference.

Figure 3:
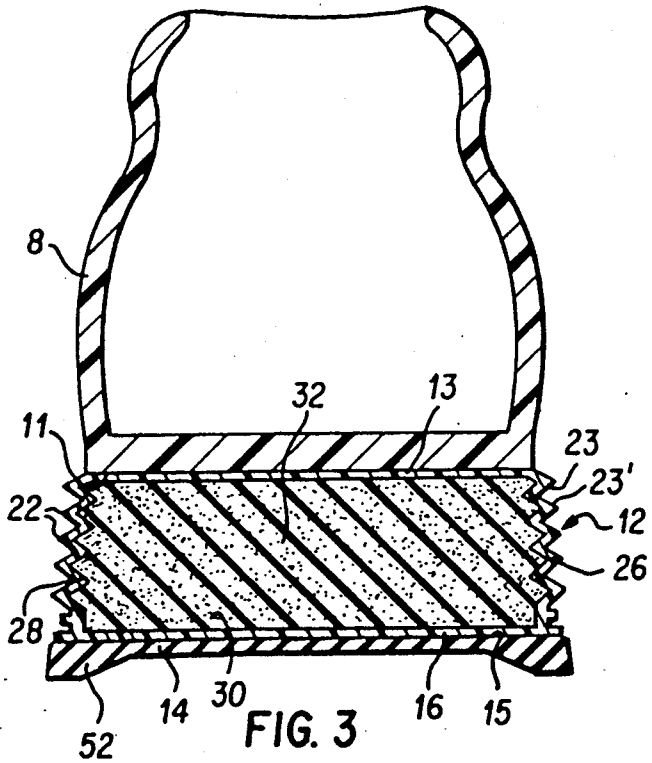
FIG. 3 is a cross sectional view of the athletic shoe taken along line 3—3 in FIG. 1.
Figure 4:
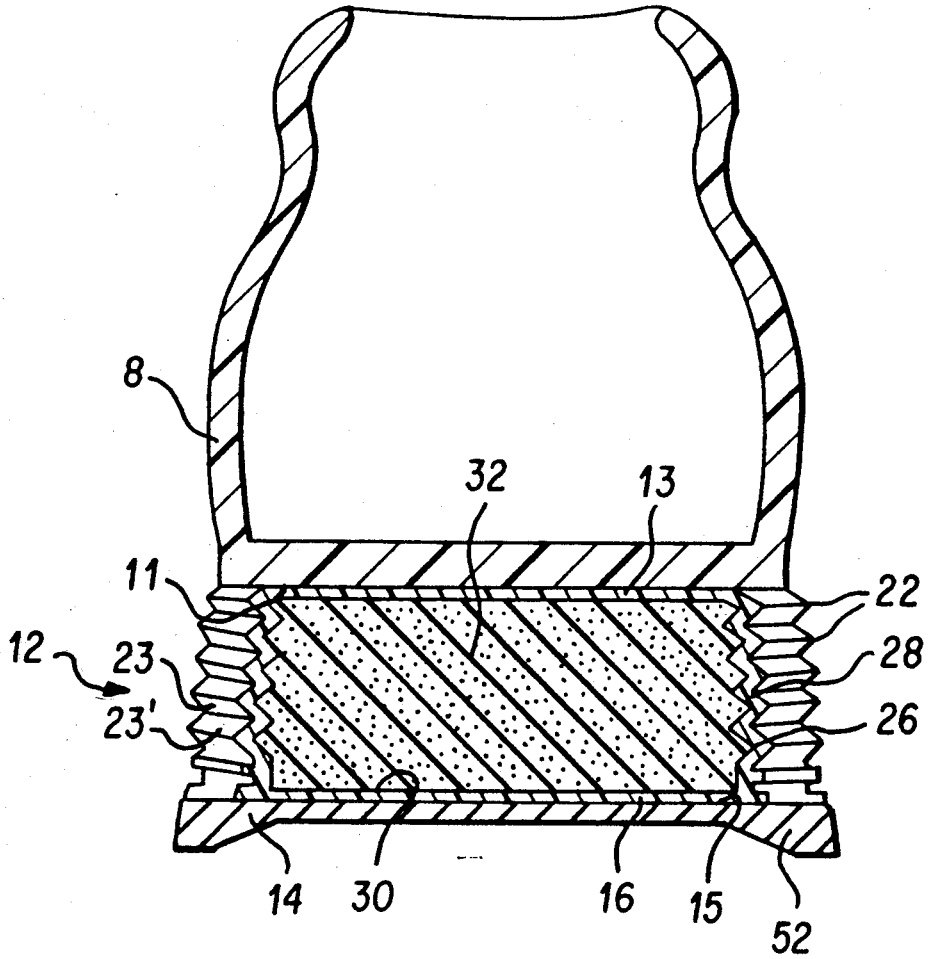
FIG. 4 is a cross sectional view of the athletic shoe taken along line 4—4 in FIG. 1.

Referring more particularly to FIGS. 3 and 4, intermediate layer 12 is disposed between outer sole 14 and upper 8. An upper surface 13 of intermediate layer 12 is secured along the lasting margin 11 of the bottom surface of upper 10. A lower surface 16 of intermediate layer 12 is secured to a top surface 15 of outer sole 14. Intermediate layer 12 is preferably secured to outer sole 14 and upper 10 by adhesives. However, other suitable securing means may be utilized, for example, radio frequency welding. Furthermore, the present invention should not be limited to the particular securement configuration shown; that is, it is not necessary that intermediate layer 12 be directly affixed to upper 8 or directly affixed to outer sole 14 as additional layers or materials may be interposed above and below intermediate layer 12. As can best be seen from FIG. 5, intermediate layer 12 has a medial side 17, a lateral side 18, a forefoot or front region 19, a center region 20 and a heel or rear region 21.

Figure 5:
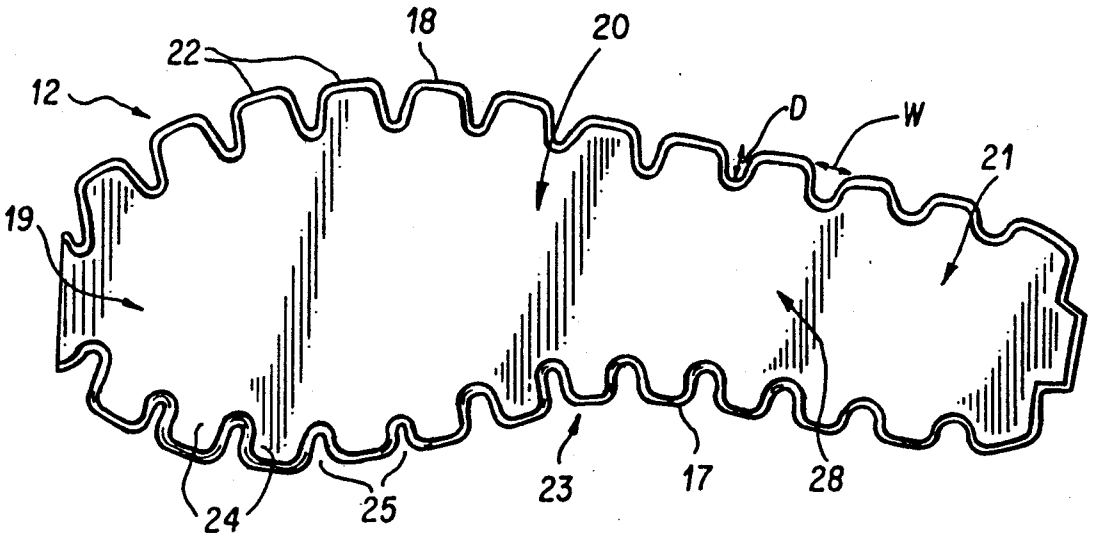
FIG. 5 is a top plan view of the intermediate layer of the present invention shown removed from the shoe.

With continuing reference to FIG. 5, intermediate layer 12 is preferably shaped to conform to the shape of outer sole 14. That is, intermediate layer 12 follows the profile of the human foot, including a curved in arch area designated generally by 23. Furthermore, as best seen in FIG. 1, the height of intermediate layer 12 in heel region 21, measured by the distance between upper surface 13 and lower surface 16, is greater than the height in front region 19. Intermediate layer 12 preferably progressively increases in height beginning at center region 20. In the embodiment shown in FIGS. 1–5, the greatest height of intermediate layer 12 is in heel region 21 which is approximately two centimeters; and the smallest height is in forefoot region 19 which is approximately one centimeter. Obviously, the height of intermediate layer 12 can be varied from that disclosed herein and the height in the heel region 21 could alternately be less than or equal to the height in the forefoot region.

One aspect of the present invention, although not limited thereto, is the material from which intermediate layer 12 is constructed. Intermediate layer 12 is preferably composed of a thermoplastic elastomer which exhibits the following characteristics:

| | |
|---|---|
| SPECIFIC GRAVITY | 1.0 to 1.5 |
| FLEXURAL MODULUS psi | 40,000–75,000 |
| IZOD IMPACT, notched ft-lbs/in | 2.0-NB |
| TENSILE PROPERTIES | |
| at 10% Elongation psi | 2,500–4,000 |
| at 15% Elongation psi | 3,000–4,400 |
| Tensile Strength psi | 6,000–9,300 |
| Elongation at Break, % | 300–500 |

One example of a suitable elastomer is HYTREL, a polyester elastomer available from E. I. Dupont de Nemours, Wilmington, Del. One form of HYTREL of particular suitability is type HTX-8177. Such material has the advantage of being a lightweight, non-fatigue material, which is highly desirous in athletic shoes; as well as having a high tear strength which makes the shoe sole more durable than soles utilizing midsoles formed substantially of cellular PU or EVA. A mixture of other grades of HYTREL, or of other materials, may be utilized so long as they generally exhibit the characteristics noted above. Furthermore, if a clear shell is desired, a polyester elastomer such as SURLYN (also available from E. I. DuPont de Nemours) which is capable of being made transparent, may be used.

Intermediate layer 12 is preferably constructed as a hollow shell 28 by blow-molding, a technique known in the art. However, other techniques for constructing a hollow shell may also be used, for example, injection molding; rotational molding; and injection blow molding. The interior of shell 28 is defined by an outer wall 26 which forms a hollow chamber 30 (see FIGS. 3 and 4). Outer wall 26 is approximately 0.25 mm to 1.5 mm in thickness and preferably is 0.5 mm in thickness. Chamber 30 may contain a filler such as: air at ambient pressure; fluid other than air; pressurized air or gas; or synthetic foam. FIGS. 3 and 4 show an example of the present invention in which a foam 32 is encapsulated within chamber 30 of shell 28. A suitable foam for encapsulation within shell 28 is PU, EVA or SURLYN. Another aspect of the present invention, although not limited thereto, is the type of foam which is encapsulated within shell 28. It is preferred that foam 32 have a specific gravity less than that of shell 28 and within the range of approximately 0.08 to 0.20. Preferably, the specific gravity of foam 32 is 0.12. Of course, the present invention is not limited to this specific gravity range, neither is the invention limited to the use of foam as a filler. However, one advantage of this embodiment of the present invention is that it allows very lightweight foams to be effectively utilized in athletic shoe soles by providing a protective plastic shell outer covering to prolong the wear-life of the intermediate layer. The material forming foam 32 is preferably injected within chamber 30 and foamed therein. However, other methods of providing foam 32 within chamber 30 are possible, for example, the foam and a blowing agent may be inserted within chamber 30 and expanded therein.

Foam 32 is preferably of uniform density throughout chamber 30. However, it may also be possible to vary the density, and thus the stiffness of the foam along various regions of intermediate layer 12 to modify the stiffness of the sole. For example, the foam in the heel region 21 may be more dense than the foam in forefoot region 19. Similarly, the density of the foam along the medial side of the shoe may be different than the foam along the lateral side. Furthermore, it may be possible to provide foam 32 in selected areas of chamber 30, while leaving other areas foam-free or filled with ambient air, fluid other than air, or pressurized air or gas. In addition, plugs made of a more dense foam may be inserted into foam 32 to provide selected areas of hardness.

With continuing reference to FIG. 3 formed along the periphery of intermediate layer 12 are convolutions 22. Convolutions 22 preferably extend horizontally from upper surface 13 of intermediate layer 12 to lower surface 16. Each convolution 22 is formed by oppositely-angled surfaces 23, 23' which create a bellows-like structure allowing intermediate layer 12 to compress in an accordion-like fashion when force is applied to upper surface 13 or to lower surface 16; and to expand to its original configuration when force is removed, as will be explained in more detail below. Surfaces 23 and 23' are shown in the figures as planar. Alternatively, surfaces 23 and 23' may be arcuate. As best seen in FIG. 5, convolutions 22 are preferably arranged in a series of independent vertical columns 24 which are spaced apart from one another to form recesses 25 between adjacent columns. Recesses 25 are shown formed along substantially the entire periphery of intermediate layer 12. However, as discussed below, recesses 25 may be provided in only selected areas of intermediate layer 12 to allow adjustment of the degree of compression along intermediate layer 12 Recesses 25 provide an effective means for controlling the compressibility of intermediate layer 12. That is, convolutions 22 may be compressed more easily at columns 24 than at recesses 25, thus providing both increased cushioning and stability to the foot of the wearer. This concept will be explained in more detail below.

The particular number of convolutions 22 in each column 24 will likely vary along the medial and lateral peripheral portions 17 and 18 of intermediate layer 12. As best seen in FIG. 1, there is a greater number of convolutions (i.e., five) in heel portion 21 than the number (i.e., two) in forefoot portion 19. The exact number of convolutions per column may be other than that shown. Furthermore, the width w and depth d (see FIG. 5) of recesses 25 between adjacent columns 24 can also be varied to form columns of varying size and shape. The depth d of recesses 25 along lateral side 18 is approximately 3 mm to 8 mm, and preferably 5 mm; and along medial side 17, approximately 3 mm to 15 mm, and preferably 8 mm. The width w of recess 25 from the center of adjacent columns is approximately 10 mm to 25 mm, and preferably 22 mm on lateral side 18; and 18 mm along medial side 17. By varying the dimension and placement of recess 25, the overall flexibility and stiffness of intermediate layer 12 may be modified. For example, the depth and width of recesses 25 in heel region 21 and center region 20 may be greater than those in forefoot region 19. Similarly, the depth and width of recesses in heel region 21 may be greater along the medial side 17 or lateral side 18 of the intermediate layer to increase the stiffness in the particular region. For example, where the width of all recesses 25 is 18 mm, the depth along the medial side may be 5 mm, while the depth along the lateral side may be 10 mm.

Thus, the present invention advantageously allows for the stiffness of intermediate layer 12 to be varied by changing one or more of the characteristics of convolutions 22, columns 24, and recesses 25. For example, to increase the stiffness of intermediate layer 12, one or more of the following changes can be made: (a) increase the number of convolutions 22; (b) increase the depth of the recesses 25; (c) increase the wall thickness of the convolutions 22; (d) increase the number of columns 24; and (e) increase the density of foam 32. Conversely, to decrease the stiffness of intermediate layer 12, one or more of the following modifications can be made: (a) decrease the number of convolutions 22; (b) decrease the depth of recesses 25; (c) decrease the wall thickness of the convolutions 22; (d) decrease the number of columns 24; and (e) decrease the density of foam 32. Furthermore, when modifying the stiffness of only a portion of intermediate layer 12 is desired, for example, the medial portion of heel region 21 to prevent pronation (i.e. the common condition of the human foot during the gait cycle, wherein the back of the foot everts), such modification can be achieved by varying the columns, convolutions, and/or recesses that are present in that particular portion of intermediate layer 12. For example, if increased stiffness is desired on medial side 17, deeper recesses can be provided in that area. While FIG. 5 shows intermediate layer 12 where the column size and recess depth are uniform throughout the periphery of the layer (i.e., uniformly arranged), it should be understood that various modifications are possible. Therefore, it should be apparent that the particular number and dimension of columns 24 and their associated recesses 25 shown in the figures is but one example of the almost infinite number of configurations of the intermediate layer which can be provided.

An alternate embodiment of the present invention is illustrated in FIGS. 6–11 in which similar reference numerals designated with regard to the embodiment described above in FIGS. 1–5 have been maintained. In general, this embodiment provides the intermediate layer of the present invention as separate insert members received within cavities formed in a middle layer or cradle 38. Cradle 38 is disposed between an outer sole and an upper (not shown).

Figure 6:
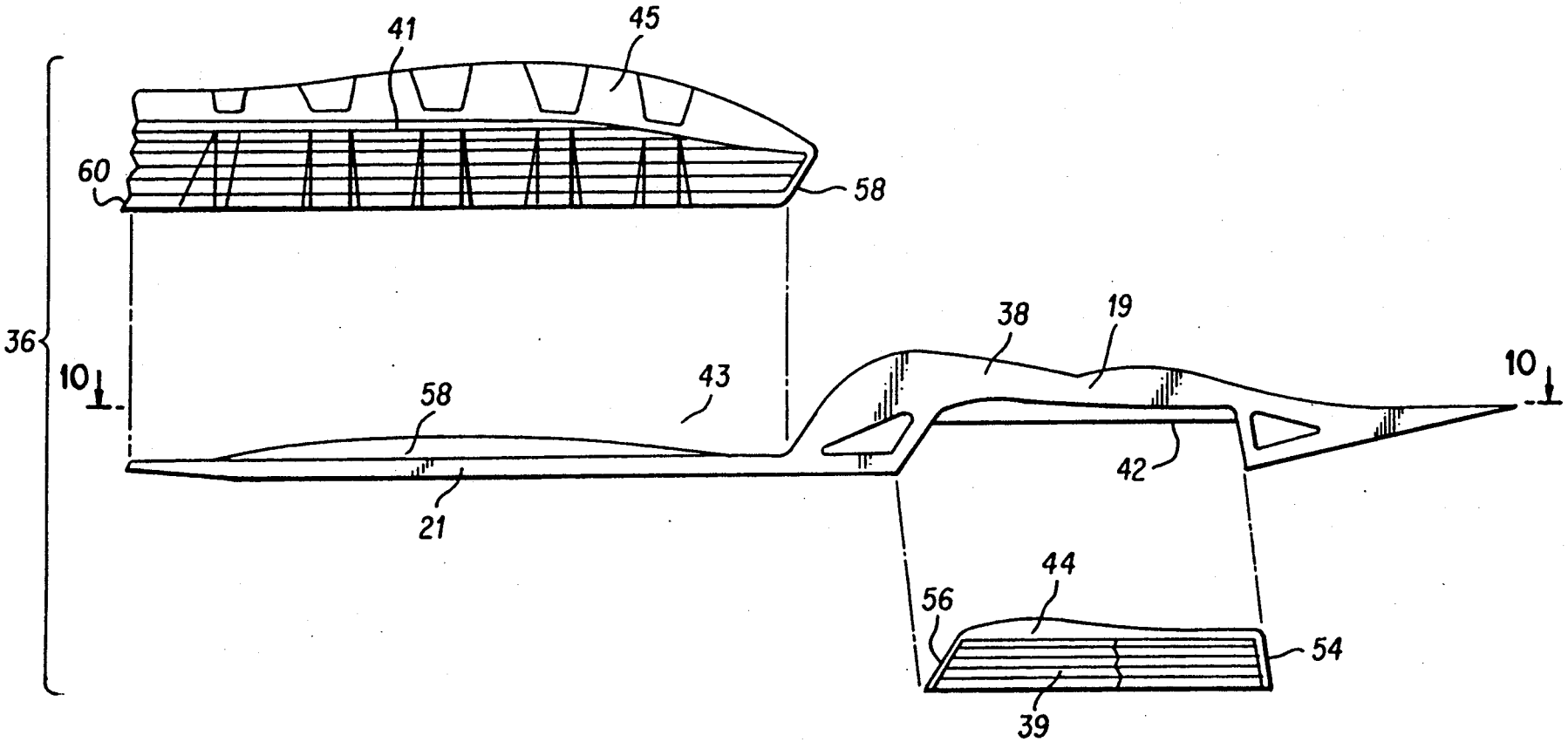
FIG. 6 is an exploded view of an alternate embodiment of the present invention showing discrete heel and forefoot inserts supported in a cradle element.

FIG. 6 shows the three major components of this embodiment of the invention. The components are a forefoot insert 39, a heel insert 41, and cradle 38, all of which together comprise an intermediate layer of midsole member 36. Cradle 38 is preferably made of a resilient material such as foamed PU or EVA having a density less than that of inserts 39 and 41. Where PU is used, the specific gravity may range from 0.20 to 0.50, with a preferred specific gravity of 0.25; and when EVA is used, the specific gravity may range from 0.10 to 0.30, with a preferred specific gravity of 0.15. EVA is characteristically softer, more lightweight, and provides more cushioning than PU.

Figure 11:
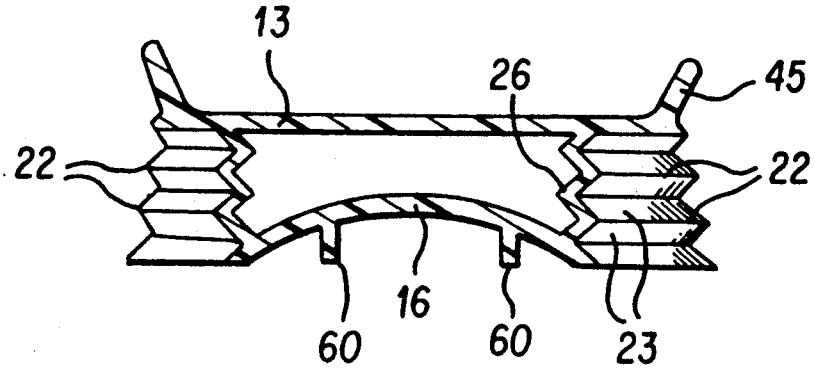
FIG. 11 is a cross sectional view taken along line 11—11 of FIG. 9.
Figure 7:
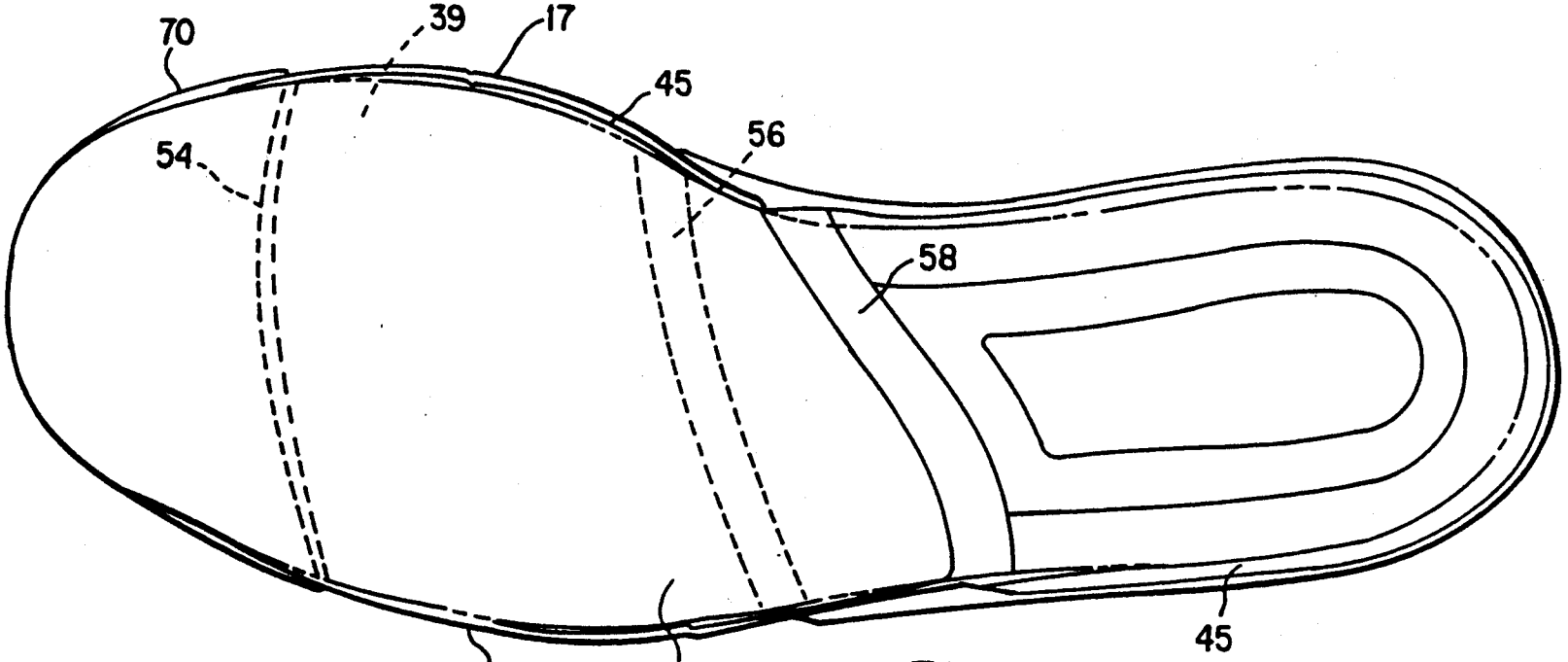
FIG. 7 is a top plan view of the intermediate layer of FIG. 6.
Figure 9:
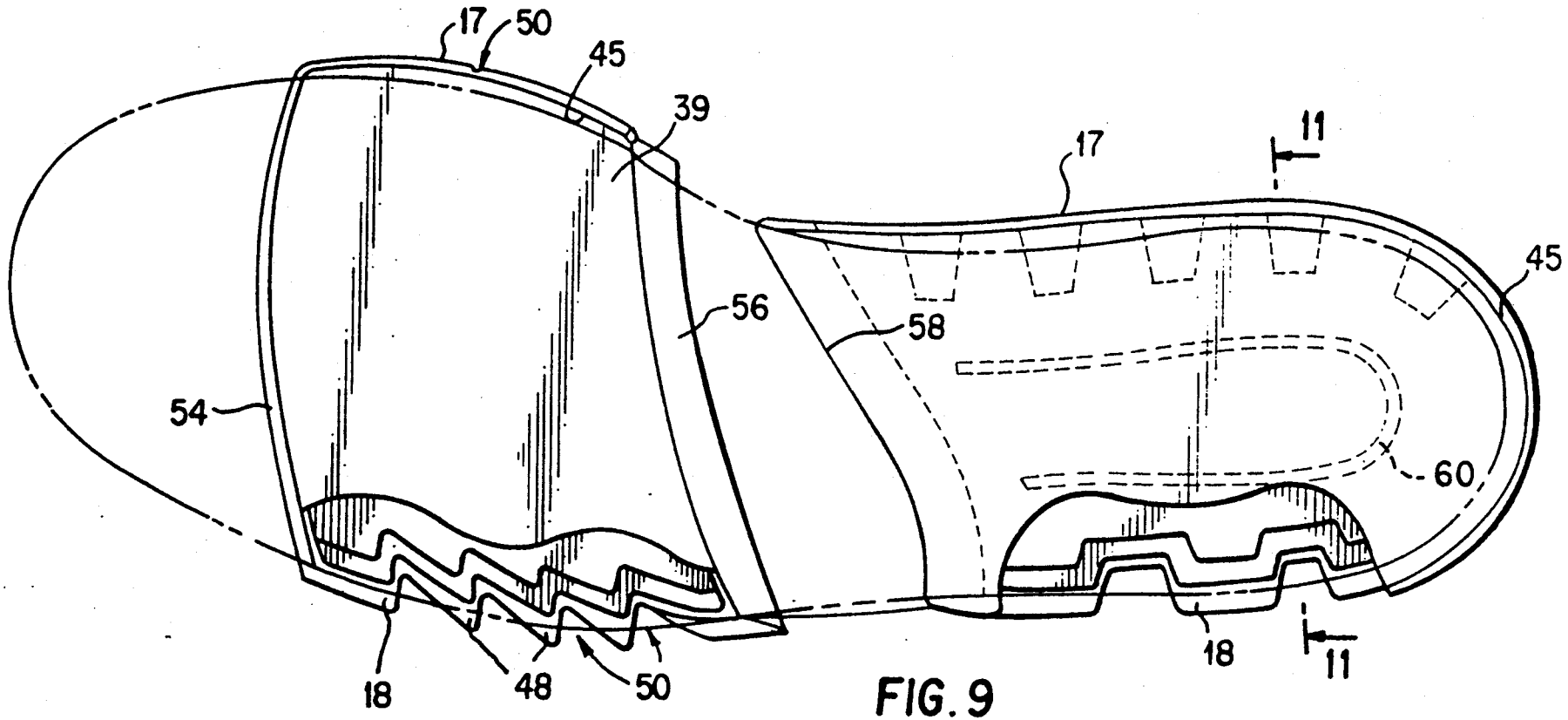
FIG. 9 is a top plan view of the forefoot and heel inserts of FIG. 8, in partial cutaway showing, in phantom, the cradle element.

As seen in FIG. 7, the outer periphery 70 of cradle 38 generally follows the profile of the human foot. Cradle 38 includes a forefoot cavity 42 on the bottom surface 68 of cradle 38 and a heel cavity 43 on the upper surface 66 of cradle 38 (see FIG. 10). Forefoot cavity 42 and heel cavity 43 are adapted to receive forefoot insert 39 and heel insert 41, respectively. An interior flange 58 is provided in heel region 21 extending upwardly into cavity 43. Flange 58 helps support heel insert 41 within cradle 38, providing a cementing surface for attachment of, and a smooth transition with, heel insert 41. Thus, flange 58 cooperates with downwardly depending flange 60 of heel insert 41 (FIGS. 9 and 11). As shown in FIGS. 6 and 9, forefoot insert 39 includes a front wall 54 and a rear wall 56 which are slightly angled or beveled. Heel insert 41 includes a front wall 58 which is also slightly angled or beveled. Although forefoot insert 39 is shown positioned below cradle 38 and heel insert 41 is shown positioned above cradle 38 (FIG. 6), other arrangements of cradle 38 and inserts 39 and 41 are possible. Furthermore, a single cavity may be provided in cradle 38 to receive a single insert. The cavity may be disposed on the upper surface or bottom surface of cradle 38 and may be disposed in the forefoot region, central region, heel region or a combination of any two regions or all three.

Figure 10:
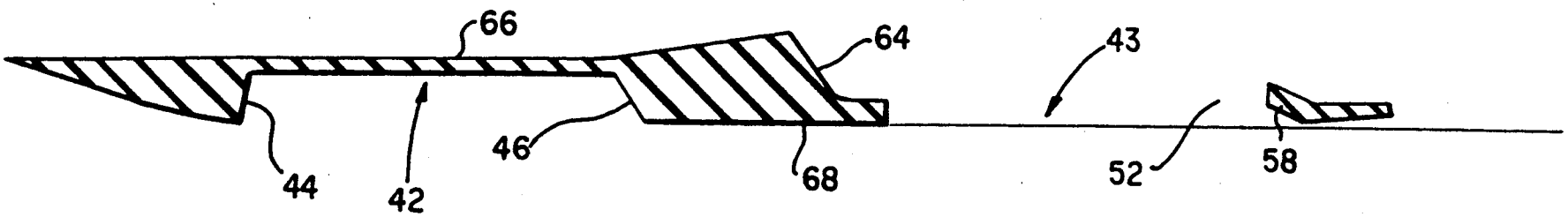
FIG. 10 is a cross sectional view of the cradle element, taken along line 10—10 of FIG. 6.
Figure 8:
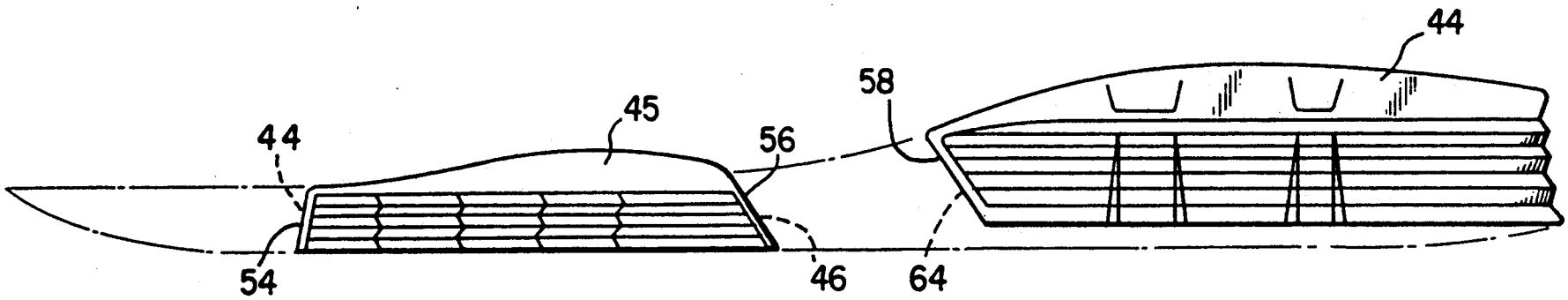
FIG. 8 is a side view of the forefoot and heel inserts of FIG. 6 shown within the cradle element.

As shown in FIG. 10, forefoot cavity 42 includes a bevelled front edge 44 and a bevelled rear edge 46. Heel cavity 43 includes beveled front edge 64. With reference to FIG. 8, edges 44, 46 cooperate with the angled walls 60, 62 and 64 of forefoot insert 39 and edge 64 cooperates with the angled wall 64 of heel insert 41 to form a tight fit. As with the previous embodiment, the height of the insert in the forefoot region 19 may be less than that in the heel region 21. Inserts 39 and 41 may include upstanding flanges 44 and 45 respectively along their medial and lateral sides for adding stability to the shoe upper (not shown).

With continuing reference to FIG. 10, rearfoot cavity 43 includes a cutout 52 in the bottom surface of cradle 38 allowing heel insert 39 to be visible through the bottom of cradle 38. A similar cutout may also be provided in the outsole to which midsole 36 is attached to allow the insert to be visible through the outsole. A protective layer which is preferably transparent may be provided on the exterior wear surface of the outsole positioned over the cutout.

As best seen in FIG. 9 and in phantom in FIG. 7, the length of forefoot insert 39 measured as the distance between front wall 54 and rear wall 56, progressively increases from medial side 17 to lateral side 18. Thus, the distance is approximately 70 mm on medial side 17 and 90 mm on lateral side 18. The heel insert, on the other hand, progressively decreases in length, as measured by the distance between front edge 58 to heel end 60, from medial side 17 to lateral side 18, such that it is approximately 126 mm on the medial side and 100 mm on the lateral side. Obviously, the length of the inserts could vary from that disclosed herein.

Both forefoot and heel inserts 39 and 41, like intermediate layer 12, are preferably hollow (see FIG. 11) and are formed by blow-molding. A plurality of convolutions 22, similar to those described above, are arranged in discrete independent columns 24 along at least a portion of the periphery of inserts 39 and 41. Columns 24 of heel insert 41 are separated by recesses 25 similar to those in the embodiment of FIGS. 1–5. As is best seen in FIG. 9, the convolutions 22 of forefoot insert 39 are shown arranged in columns 48 angled to a central axis of midsole member 36, separated by angled recesses 50. Angling the columns in the forefoot area increases the bending flexibility of insert 39, a characteristic which is particularly desirable along the metatarsal area of the foot. While FIG. 9 shows three angled columns 48 and four angled recesses 50 along lateral side 18 of insert 39, and a single angled recess 50 along medial side 17, the particular number of recesses and columns may be varied in order to modify the flexibility of insert 39. Furthermore, if desired, angled recess 50 may be provided in heel insert 41; and recesses 25 may be provided in forefoot insert 39. It should be apparent to those skilled in the art that angled recesses may also be provided in intermediate layer 12 of FIGS. 1–5 described above.

As with intermediate layer 12, the depth and width of recesses 25 and 50 between columns 24 and 48 respectively may be varied in order to vary the stiffness of the particular insert. Similarly, the number of columns, placement and wall thickness may be varied to provide a customized insert to meet the particular needs of the user. Moreover, as with intermediate layer 12, chamber 30 provided within inserts 39 and 41 may be provided with a filler material such as ambient air; fluid other than air; pressurized air or gas; or synthetic foam.

In use of either the embodiment of FIGS. 1–5, or FIGS. 6–11, when force is provided on the upper surface of intermediate layer 12 or 36 by the weight of a wearer during the gait cycle, the force is transferred to intermediate layer 12 or 36, respectively. Such force causes convolutions 22 to compress in an accordion-like fashion to cushion the wearer's foot. When the force is removed, the convolutions 22 expand back to their original configuration. When foam 32 is provided within intermediate layer 12, or inserts 39 and 41, such foam further aids in compression and expansion of the convolutions 22.

While the present invention has been shown embodied as either a full insert for the entire length of the sole, or as two individual inserts, one provided in the heel area, the other in the forefoot area of the sole, inserts in other areas of the sole may be provided as desired. These inserts may be in addition to the heel and/or forefoot inserts or as a substitute for these inserts. Additionally, an insert which substantially joins heel insert 41 with forefoot insert 39 through the arch area, leaving the toe area of the sole insert-free, may also be provided.

While convolutions 22 of both embodiments of the present invention are shown unprotected and exposed, it is possible to provide a outer covering of foam or other material to protect the convolutions from being clogged by dirt and other debris associated with the ground. Such an outer covering may be transparent so that the interior cushioning of the intermediate layer is visible. If such an outer layer is provided, it should not interfere with the proper functioning of convolutions 22, i.e., that they be allowed to contract and expand as force is applied thereto.

It is to be understood that the foregoing is considered as illustrative only of the principles of the invention. Therefore, within the scope of the appended claims, the invention may be practiced otherwise than as specifically described herein.

What is claimed is:

1. A shoe sole construction comprising an intermediate layer for supporting the forces generated by a wearer, said intermediate layer including a hollow outer shell defined by a top surface and a bottom surface connected by an outer periphery; and a plurality of convolutions arranged horizontally along a substantial portion of said outer periphery of said intermediate layer extending from said top surface to said bottom surface in independent vertical columns along said outer periphery of said intermediate layer with a recess formed between adjacent columns, whereby said convolution compress in an accordion-like fashion when force is applied thereto.

2. A shoe sole construction, as set forth in claim 1, wherein said columns are uniformly arranged along said outer periphery of said intermediate layer.

3. A shoe sole construction, as set forth in claim 1, wherein said columns are arranged at an angle to a central axis of said intermediate layer.

4. A shoe sole construction for a shoe comprising a resilient midsole cradle element, said midsole cradle element including a cavity; and a hollow insert disposed within said cavity;

said hollow insert including a plurality of convolutions arranged horizontally along a portion of said insert in independent vertical columns along an outer periphery of said hollow insert with a recess formed between adjacent columns such that said convolutions compress in an accordion-like fashion when force is applied thereto.

5. A shoe sole, as set forth in claim 4, wherein said insert is disposed in a heel region of said midsole cradle element.

6. A shoe sole, as set forth in claim 4, wherein said insert is disposed in a forefoot region of said midsole cradle element.

7. A shoe sole, as set forth in claim 4, wherein said midsole cradle element further comprises a second hollow insert disposed in a heel region of said midsole cradle element.

8. A shoe sole, as set forth in claim 7, further comprising a filler material disposed within both of said inserts.

9. A shoe sole as set forth in claim 4, wherein said cavity is formed in an upper surface of said midsole cradle element.

10. A shoe sole, as set forth in claim 4, wherein said cavity is formed in a bottom surface of said midsole cradle element.

* * * * *

UNITED STATES PATENT AND TRADEMARK OFFICE

CERTIFICATE OF CORRECTION

PATENT NO. : 5,014,449

DATED : May 14, 1991

INVENTOR(S) : Daniel Richard, Kenneth Kolman, Charles Case, Ronald Becker
Alex Gross

It is certified that error appears in the above-identified patent and that said Letters Patent is hereby corrected as shown below:

Column 9, line 4, delete "convolution" and insert

--convolutions-- therefor; and

Column 10, line 9, delete "4" and insert --6-- therefor.

Signed and Sealed this

Sixth Day of October, 1992

*Attest:*

DOUGLAS B. COMER

*Attesting Officer*

*Acting Commissioner of Patents and Trademarks*